US009270013B2

(12) United States Patent
Ley

(10) Patent No.: US 9,270,013 B2
(45) Date of Patent: Feb. 23, 2016

(54) REFLECTOR ARRANGEMENT FOR ATTACHMENT TO A WIRELESS COMMUNICATIONS TERMINAL

(71) Applicant: CAMBIUM NETWORKS, LTD, Devon (GB)

(72) Inventor: John F. Ley, Oregon, IL (US)

(73) Assignee: CAMBIUM NETWORKS, LTD, Ashburton, Devon (GB)

( * ) Notice: Subject to any disclaimer, the term of this patent is extended or adjusted under 35 U.S.C. 154(b) by 451 days.

(21) Appl. No.: 13/660,731

(22) Filed: Oct. 25, 2012

(65) Prior Publication Data

US 2014/0118220 A1 May 1, 2014

(51) Int. Cl.

| | |
|---|---|
| ***H01Q 15/14*** | (2006.01) |
| ***H01Q 19/10*** | (2006.01) |
| ***H01Q 19/12*** | (2006.01) |
| ***H01Q 1/24*** | (2006.01) |
| ***H01Q 19/19*** | (2006.01) |

(52) U.S. Cl.
CPC ..... *H01Q 1/243* (2013.01); *H01Q 19/19* (2013.01)

(58) Field of Classification Search
USPC ..... 343/912, 840, 834, 838
See application file for complete search history.

(56) References Cited

U.S. PATENT DOCUMENTS

| | | | | |
|---|---|---|---|---|
| 5,966,099 | A | 10/1999 | Xue | |
| 5,973,652 | A | 10/1999 | Sanford et al. | |
| 6,020,859 | A | 2/2000 | Kildal | |
| D543,975 | S | 6/2007 | McCown | |
| 7,800,551 | B2 | 9/2010 | McCown | |
| 8,085,214 | B2 | 12/2011 | McCown | |
| 2007/0296642 | A1 * | 12/2007 | McCown | 343/840 |
| 2010/0260940 | A1 | 10/2010 | McCown | |
| 2012/0176608 | A1 | 7/2012 | McCown | |

FOREIGN PATENT DOCUMENTS

| | | | |
|---|---|---|---|
| GB | 2 389 246 | A | 12/2003 |
| JP | 2002-135020 | A | 5/2002 |

(Continued)

OTHER PUBLICATIONS

Richard Corkish, The Use of Conical Tips to Improve the Impedance Matching of Cassegrain Subreflectors; Microwave and Optical Technology Letters, vol. 3, No. 9, pp. 310-313, Sep. 1990.

(Continued)

*Primary Examiner* — Graham Smith
(74) *Attorney, Agent, or Firm* — Brinks Gilson & Lione

(57) ABSTRACT

A reflector arrangement is configured for attachment to a wireless communications terminal having a patch antenna. The patch antenna includes a patch radiator in a substantially parallel relationship with a ground plane, and the patch antenna produces a radiation beam of a predetermined beamwidth. The reflector arrangement is configured, when attached to the terminal, to produce a radiation beam of reduced beamwidth relative to the predetermined beamwidth. The reflector arrangement comprises a main reflector and a sub-reflector for reflecting radiation towards the main reflector, and the reflector arrangement is configured such that, when attached to the terminal, the patch antenna acts as a feed antenna for the sub-reflector. The sub-reflector is arranged to collect the radiation from the patch antenna and to reflect the beam towards the main reflector such that the main reflector produces the radiated beam of reduced beamwidth.

17 Claims, 10 Drawing Sheets

(56) References Cited

FOREIGN PATENT DOCUMENTS

| | | |
|---|---|---|
| NL | 8006425 | 6/1982 |
| WO | WO 98/38692 | 9/1998 |
| WO | WO 98/53525 | 11/1998 |

OTHER PUBLICATIONS

International Search Report Dated Mar. 4, 2014; 4 pages; for corresponding PCT application PCT/GB2013/052797.

* cited by examiner

REFLECTOR ARRANGEMENT FOR ATTACHMENT TO A WIRELESS COMMUNICATIONS TERMINAL

BACKGROUND OF THE INVENTION

The present invention relates generally to radio frequency antenna arrangements, and more specifically, but not exclusively, to a reflector arrangement for attachment to a wireless communications terminal to increase antenna gain for transmission and reception of microwave frequency radiation in a wireless communications system.

Modern wireless communications systems place great demands on the antennas used to transmit and receive signals. In particular in a fixed wireless access system, in which a wireless terminal known as customer premises equipment may be installed at a determined orientation for communication with a base station, it may be required that an antenna produces a radiation pattern that has well defined directional characteristics so as to reduce path loss to the base station and to minimise interference to neighbouring systems, but there is also a requirement that the antenna be small, and cheap to produce.

Typically, a wireless communications terminal may be provided with an internal antenna, situated within the housing of the terminal. The internal antenna is typically designed to have sufficient gain for the majority of deployment scenarios and is designed as a trade-off between the requirements of providing high enough gain to provide a reliable link, and a low cost of manufacture and small size. The internal antenna may be a patch antenna, which may comprise a sheet of metal known as a patch radiator, disposed in a substantially parallel relationship to a ground plane. However, in some deployment scenarios, for example when the customer premises are far away from the base station, there may be a requirement for more gain than the internal antenna is designed to provide.

In order to provide more gain, the terminal may be fitted with an external device to increase antenna gain by decreasing the beamwidth of the radiation beam from the terminal. In one such arrangement, the terminal may be used to illuminate a parabolic dish reflector, which is arranged to produce a beam with a narrower beamwidth than that produced by the terminal. The terminal may be supported on an arm extending forwards of the dish, offset to one side of the dish so as not to block radiation from the dish. However, such arrangements are typically bulky and require the orientation of a terminal that has already been installed to be changed.

In an alternative arrangement to improve antenna gain, the terminal may be fitted with a device that has a dish reflector and a microwave feed assembly comprising two antennas connected together by a transmission line. One of the two antennas is a coupling antenna used to couple radio frequency signals to and from the internal antenna in the terminal. The other antenna is a feed antenna, typically a dipole, used to illuminate the reflector dish so that the dish reflector may produce a beam with a narrower beamwidth than that produced by the terminal. The coupling antenna may be a patch antenna, and is typically held close against the housing of the terminal in front of the internal antenna. However, this arrangement may not present a good impedance match to the transmitter in the terminal, so that signals may be reflected back into the power amplifier, potentially causing distortion of transmitted signals. Furthermore, the arrangement may be bulky and expensive to manufacture.

In another alternative arrangement, a dielectric lens may be fitted to the terminal in front of the internal antenna to increase antenna gain. However, this typically requires the use of large amounts of potentially expensive material, and may add significantly to the weight of the terminal.

It is an object of the invention to mitigate the problems of the prior art.

BRIEF SUMMARY OF THE INVENTION

In accordance with a first embodiment of the present invention, there is provided a reflector arrangement configured for attachment to a wireless communications terminal, the wireless communications terminal comprising a patch antenna including a patch radiator disposed in a substantially parallel relationship with a ground plane and the patch antenna producing a radiation beam of a predetermined beamwidth, and the reflector arrangement being configured, when attached to the terminal, to produce a radiation beam of reduced beamwidth relative to said predetermined beamwidth, the reflector arrangement comprising:

a main reflector; and a sub-reflector for reflecting radiation towards the main reflector, wherein the reflector arrangement is configured such that, when attached to the terminal, the patch antenna acts as a feed antenna for the sub-reflector, and wherein the sub-reflector is arranged to collect the radiation from the patch antenna and to reflect the beam towards the main reflector such that the main reflector produces the radiated beam of reduced beamwidth.

The configuration of the reflector arrangement for use with a patch antenna as a feed antenna for the sub-reflector may provide a compact design that is cheap to produce and that may provide a good impedance match to the patch antenna.

Further features and advantages of the invention will be apparent from the following description of preferred embodiments of the invention, which are given by way of example only.

DETAILED DESCRIPTION OF THE INVENTION

By way of example, embodiments of the invention will now be described in the context of a broadband fixed wireless access radio communications system operating in accordance with an IEEE 802.11a, b, g, n or ac standard. However, it will be understood that this is by way of example only and that other embodiments may involve other wireless systems, and may apply to point-to-point and point-to-multipoint systems, and to systems operating according to cellular radio standards.

Figure 1:
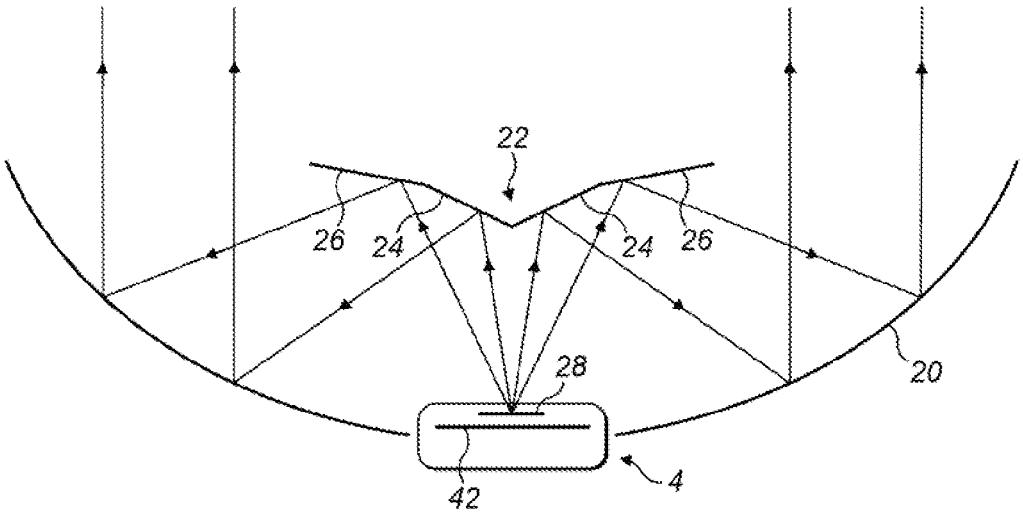
FIG. 1 is a schematic diagram of a reflector arrangement according to an embodiment of the invention showing the sub-reflector comprising a substantially conical part having an apex extending towards the patch antenna.

FIG. 1 shows an embodiment of the invention, in which a reflector arrangement 20, 22 is configured so that it may be attached to a wireless communications terminal 4 as shown. The reflector arrangement has a main reflector 20, and the internal antenna in the terminal, typically a patch antenna, acts as a feed antenna for a sub-reflector 22, which collects radiation from the patch antenna 28, 42 and reflects radiation towards the main reflector 20. The main reflector is shaped to produce a radiated beam of reduced beamwidth and hence higher antenna gain, as compared with the beamwidth and antenna gain that the internal antenna in the terminal would have when used without the reflector arrangement. The shapes of the main reflector and the sub-reflector are designed to act in conjunction with the phase and amplitude characteristics of the radiated beam from the internal antenna of the terminal to produce a main beam from the main reflector with high gain and low side lobe levels.

The internal antenna in the terminal is typically a patch antenna that includes a patch radiator 28 arranged in a substantially parallel relationship with a ground plane 42, which may be a ground layer in a printed circuit board. There may be a dielectric material between the patch radiator and the ground plane, such as a typical printed circuit board substrate comprising, for example, a composite of glass fibre and resin, or there may be an air dielectric. The patch radiator may be, for example, rectangular with one side of approximately half a wavelength in length at an operating frequency of the antenna, and is typically connected to a radio transceiver by a feed track of defined characteristic impedance, typically 50 Ohms. The patch antenna typically produces a radiation beam of a predetermined beamwidth, which may be for example approximately 84 degrees in azimuth. The reflector arrangement may be configured, when attached to the terminal, to produce a radiation beam of reduced beamwidth relative to said predetermined beamwidth, which may be, for example, approximately 14 degrees in azimuth.

The patch antenna may be a dual polarisation device, which may be configured to transmit and/or receive in one or both of two orthogonal polarisations, for example vertical and horizontal polarisations, or left and right handed circular polarisation. The reflector arrangement may preserve the polarisation state of the radiation to and from the patch antenna. So, if for example, the patch antenna is arranged to transmit vertical polarisation, the reflector arrangement may also transmit radiation with substantially vertical polarisation.

The sub-reflector 22 typically has a reflective surface, which may be formed from a metalisation layer deposited on a substrate such as a moulded plastic or resin material. As shown schematically in FIG. 1, at least a first part 24 of the reflective surface is substantially conical and has an apex. The representation in FIG. 1 is a cross-sectional view, and typically the sub-reflector is rotationally symmetric, so that the triangular cross-section shown as 24 represents a cone in three dimensions. As shown in FIG. 1, the reflector arrangement is arranged so that, when attached to the terminal 4 as shown, the apex extends towards the patch antenna 28, 42. This shaping of the sub-reflector has the effect of reducing reflection of radiation received from the patch antenna back into the patch antenna. Such a reflection would have the effect of reducing return loss, and presenting a poor impedance match to a radio transceiver connected to the internal patch antenna in the terminal.

As may also be seen from FIG. 1, the reflective surface of the sub-reflector 22 comprises a further part 26 surrounding said first part, which is shaped substantially as a truncated cone, having substantially the same axis shared axis as the first part. As may be seen from FIG. 1, the truncated cone subtends a greater angle to the shared axis than the angle subtended to the shared axis by said first part. That is to say, the further part 26 is flatter than the first part 24.

So, the first part at the centre of the sub-reflector tends to reflect radiation away from the patch antenna and preferably away from the terminal 4, which may be located in a gap in the main reflector 20. It is desirable to reflect radiation away from the terminal in this way, so that the radiation may be reflected by the main reflector 20 to form a radiated beam, rather than being absorbed or scattered by the terminal, so that the efficiency of the antenna is increased. Also, it is undesirable that radiation enters the terminal, as this may cause spurious signals within the terminal.

The further part, that is to say the flatter outer part 26 of the sub-reflector, has the effect of reflecting radiation onto a part of the main reflector 20 that is closer to the terminal 4 than would be the case if the sub-reflector were uniformly of the conical shape of the first, central, part 24. This allows the diameter of the main reflector to be reduced, minimising the size of the reflector arrangement.

Figure 2:
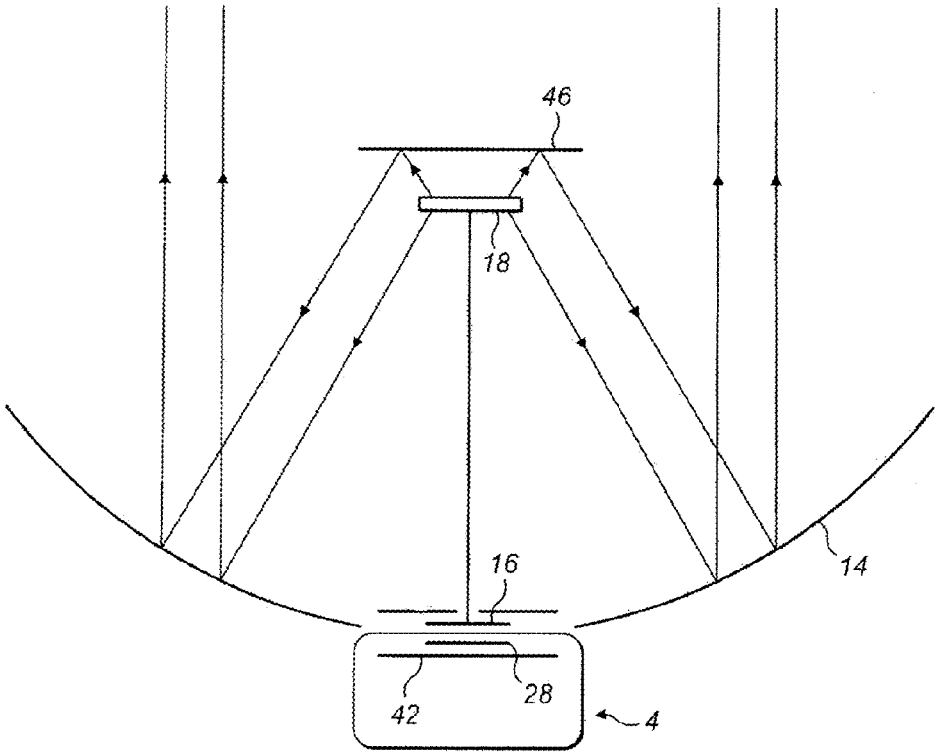
FIG. 2 Prior Art
FIG. 2 is a schematic diagram of a prior art arrangement for providing increased antenna gain for a wireless communications terminal.

The embodiment of the invention shown in FIG. 1 may be contrasted with the prior art arrangement as shown in FIG. 2. As shown in FIG. 2, a reflector dish 14 is attached to a wireless communications terminal 4 to increase the antenna gain of the terminal, by producing a beam from the reflector dish having a narrower beamwidth than the beamwidth of a beam from an internal patch antenna 28, 42 in the terminal. However, unlike the arrangement in the embodiment of the invention shown in FIG. 1, the prior art arrangement of FIG. 2 uses a microwave feed assembly comprising two antennas 16; 18 connected together by a transmission line. One of the two antennas is a patch antenna comprising a patch radiator 16 and a ground plane used to couple radio frequency signals to and from the internal patch antenna 28, 42 in the terminal, by forming a resonant cavity in conjunction with the internal patch antenna. Signals to and from the terminal are fed through the transmission line, typically a coaxial line, to and from a feed antenna 18, typically a dipole, used to illuminate the reflector dish. There may be a reflector 46 placed behind the feed antenna in order to reflect radiation that is radiated away from the reflector dish back into the reflector dish. The arrangement of FIG. 2 may be prone to poor return loss as seen from the terminal, that is to say the antenna system may present a poor impedance match to the transceiver in the terminal. The return loss may be improved by adjustment in manufacturing, but this may be expensive, and the overall design is bulky. In particular, the close-coupled arrangement involving the internal patch antenna of the terminal and the coupling antenna outside the terminal housing is difficult to arrange with sufficient tolerance to maintain consistent radio frequency performance.

Figure 3:
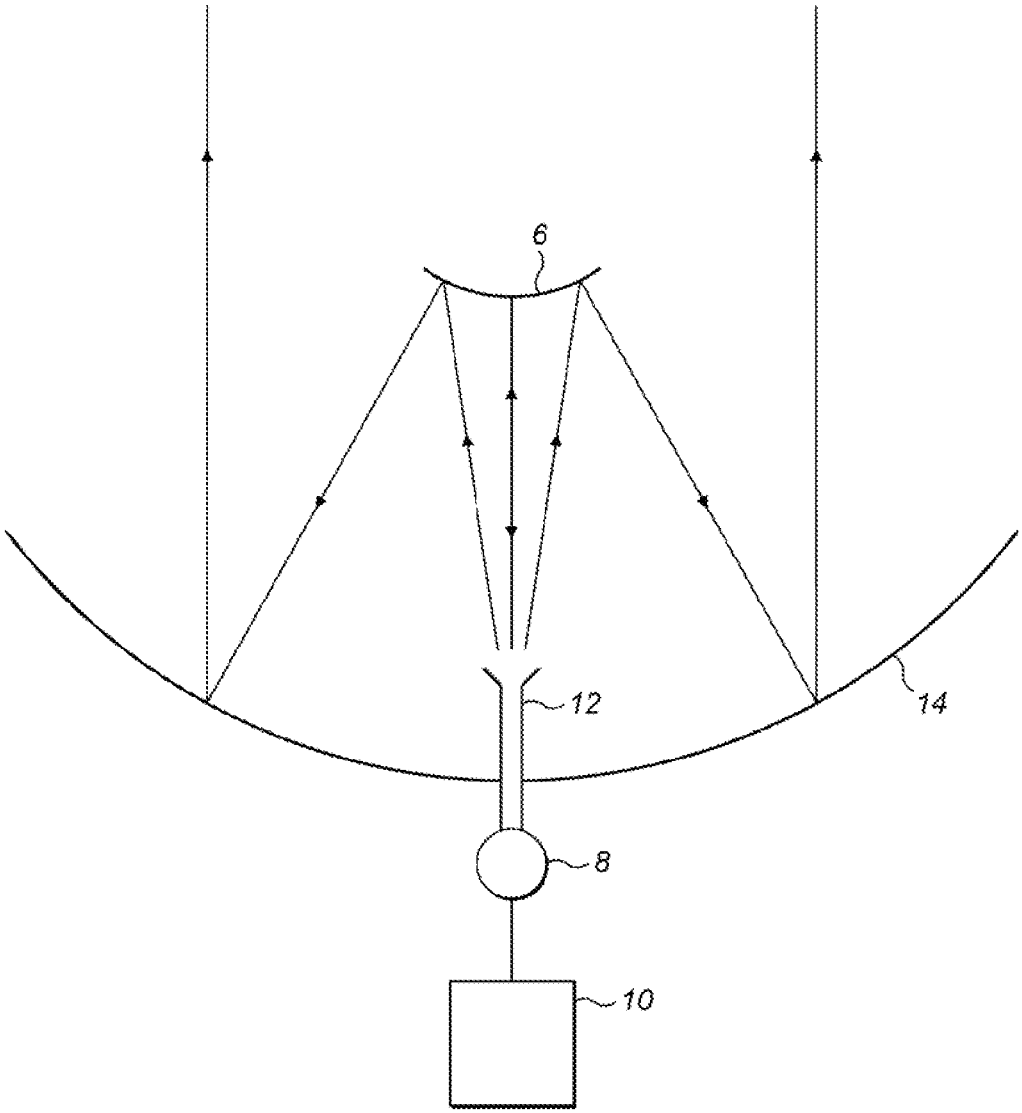
FIG. 3 Prior Art
FIG. 3 is a schematic diagram of a Cassegrain antenna according to the prior art.

The embodiment of the invention shown in FIG. 1 may be also contrasted with the conventional Cassegrain antenna shown in FIG. 3. As shown in FIG. 3, a conventional Cassegrain antenna has a parabolic main reflector 14 and a hyperbolic sub-reflector 6. The reflectors are arranged so that radiation from a feed horn 12 extending through the main reflector 14 may be reflected by the sub-reflector 6 back onto the main reflector 14, so that the radiation may emerge from the main reflector as a substantially collimated beam, which has a narrow beamwidth. Cassegrain antennas such as that shown in FIG. 2 are typically used at satellite earth stations. The Cassegrain antenna may exhibit poor return loss as seen from the feed horn due to reflections back from the sub-reflector 6. It is typically necessary to use a device with one-way transmission characteristics, such as a circulator 8, between a transmitter 10 and the feed horn 12 to protect the transmitter from signals reflected back into the feed horn from the sub-reflector 6.

It would not be obvious to use a Cassegrain arrangement instead of the close-coupled antennas and the microwave feed assembly of FIG. 2. As may be seen from FIG. 3, a Cassegrain antenna is typically used with a feed antenna such as a feed horn producing a narrow beam, and typically has a small sub-reflector supported significantly in front of the rim of the reflector dish. Such an arrangement would not be suited to the relatively wide beam produced by a patch antenna. Furthermore, it would be expected that the return loss of a Cassegrain antenna would be very poor if it were to be used with a patch antenna, due to reflections from the sub-reflector into the relatively large antenna aperture of a patch antenna. Increasing the size of the sub-reflector would be expected to exacerbate the problem of poor return loss with a conventional Cassegrain design.

As may be seen from FIG. 1, the area of the sub-reflector, projected to the plane of the rim of the main reflector, is relatively large in an embodiment of the invention compared to conventional Cassegrain designs. This allows the sub-reflector to collect radiated energy from the relatively broad beam from the patch reflector, but may be expected to block the radiating aperture of the main reflector, reducing the gain and efficiency of the reflector arrangement. However, it has been found that the configuration of the reflector arrangement, particularly in terms of the shaping of the sub-reflector in conjunction with the shaping of the main reflector (as shown in detail in FIGS. 6, 7 and 8) and the beam shape produced by the patch antenna, may avoid excessive blocking an may overcome the limitations that may be expected of a Cassegrain approach using a patch antenna as a feed antenna.

In an embodiment of the invention, a projected area of the reflective surface of the sub-reflector is greater than one eighth of a projected area of the main reflector (the projected areas being measured in a plane normal to the direction of a radiation beam produced by the main reflector). As has been mentioned, this would be a relatively large sub-reflector area for a Cassegrain design. A projected sub-reflector area between of 15% and 25% of the projected area of the main reflector may be particularly advantageous.

Figure 4:
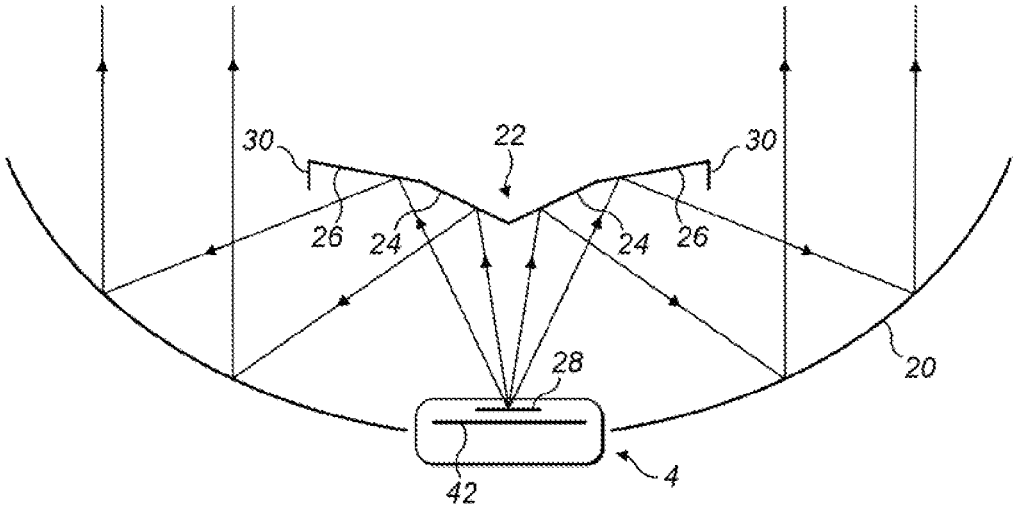
FIG. 4 is a schematic diagram of a reflector arrangement according to an embodiment of the invention showing the sub-reflector comprising a reflective barrier disposed around the perimeter of the sub-reflector.

FIG. 4 shows an embodiment of the invention in which the sub-reflector 22 has a reflective barrier 30 around the perimeter of the sub-reflector. As can be seen from FIG. 4, the reflective barrier extends from the perimeter of the sub-reflector towards the main reflector. The reflective barrier may be formed as a metalisation layer on the surface of a projection from the sub-reflector, that may be formed as an integral pan of the sub-reflector, for example by molding. The reflective barrier may reduce sidelobe levels from in the radiation beam produced by the main reflector 20, while reducing the required diameter of the sub-reflector. As may be seen from FIG. 4, the reflective barrier, which may also be referred to as a lip, may intercept radiation from the patch antenna that would otherwise just miss the edge of the sub-reflector and prevent it from being radiated directly out of the reflector arrangement as a sidelobe of the main beam. The intercepted radiation may be reflected back into the main reflector.

It should be noted that the ray diagrams shown in FIGS. 1 to 5 are a simplification of the radiation process; diffraction effects are also important, since the wavelengths of the signals radiated at the operating frequencies of the reflector arrangements may be a significant proportion of the size of the structures. For example, in an embodiment of the invention, the diameter of the sub-reflector may be substantially in the region two to four wavelengths. The operating frequencies may typically be microwave frequencies, from approximately 300 MHz to 30 GHz. Preferred operating frequencies may be in the range 1 GHz-10 GHz, and embodiments of the invention may operate at various frequency bands including 2.4 GHz and various frequency bands from 5.2 GHz to 5.8 GHz, for example.

In an embodiment of the invention, the reflective barrier has a height measured in a direction towards the main reflector from the perimeter of the reflective surface of greater than one sixteenth of a wavelength and less than one quarter of a wavelength at an operating frequency of the antenna. Typically, the height of the reflective barrier may be substantially one eighth of a wavelength. As may be seen from FIG. 4, the reflective barrier may be substantially perpendicular to a plane normal to the direction of a radiation beam produced by the feed antenna.

Figure 5:
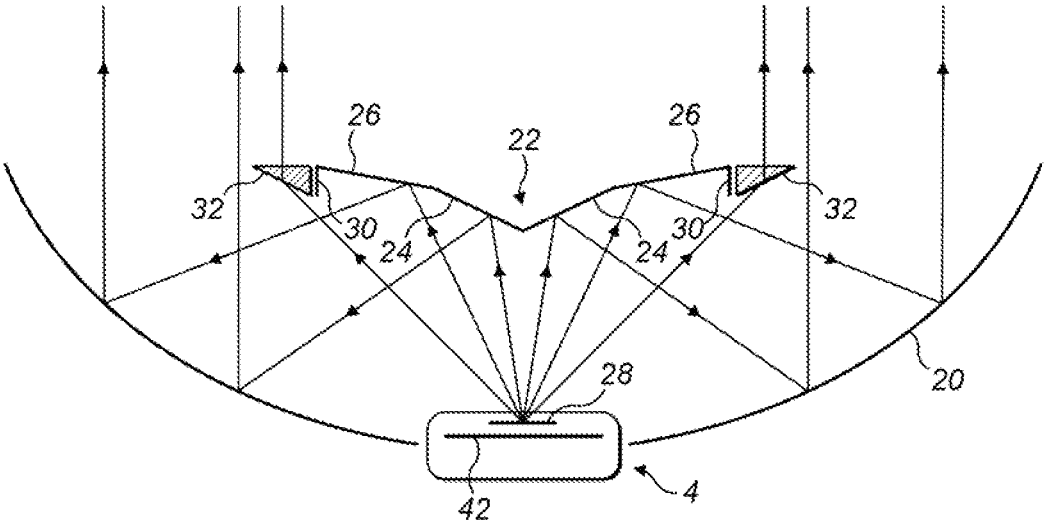
FIG. 5 is a schematic diagram of a reflector arrangement according to an embodiment of the invention showing the reflector arrangement comprising a dielectric ring disposed around the perimeter of the sub-reflector.

FIG. 5 shows a reflector arrangement comprising a dielectric ring 32 disposed around the perimeter of the sub-reflector, the dielectric ring extending radially outwards from the perimeter of the sub-reflector. The dielectric ring may be employed in embodiments of the invention with or without the reflective barrier 30. The effect of the dielectric ring, as shown in an approximated ray diagram in FIG. 5, is to reduce sidelobe levels in the beam produced by the main reflector by refracting radiation from the patch antenna that would otherwise just miss the edge of the sub-reflector, and direct it closer to the main beam direction. Although shown in FIG. 5 as a ray diagram, nevertheless diffraction effects play a part in deflecting radiation and reducing sidelobe levels.

In an embodiment of the invention, the dielectric ring extends radially outwards from the perimeter of the sub-reflector by a distance of between one eighth and one half of a wavelength at an operating frequency of the antenna.

Figure 6:
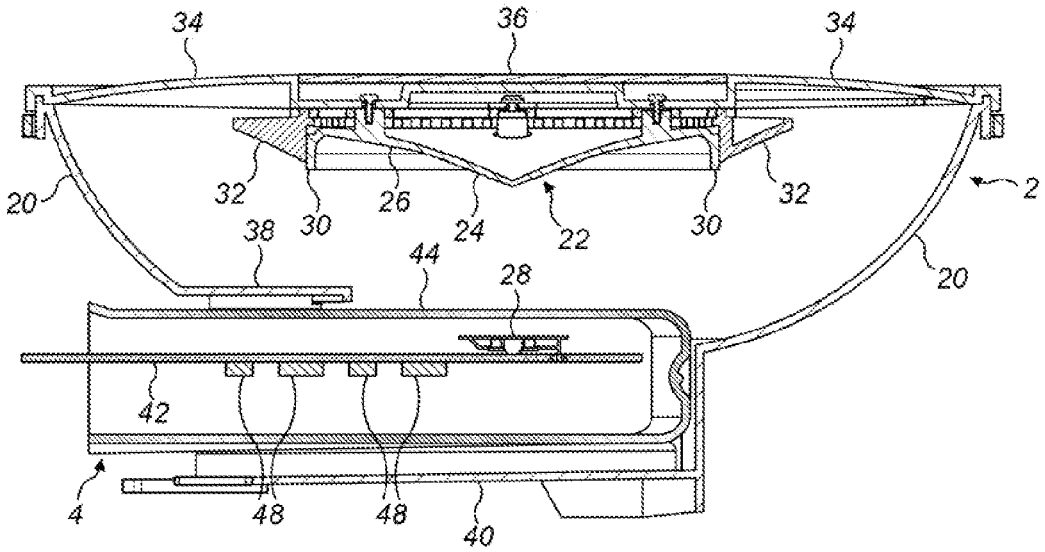
FIG. 6 is a sectional view of a reflector arrangement according to an embodiment of the invention when fitted to a wireless communications terminal.
Figure 7:
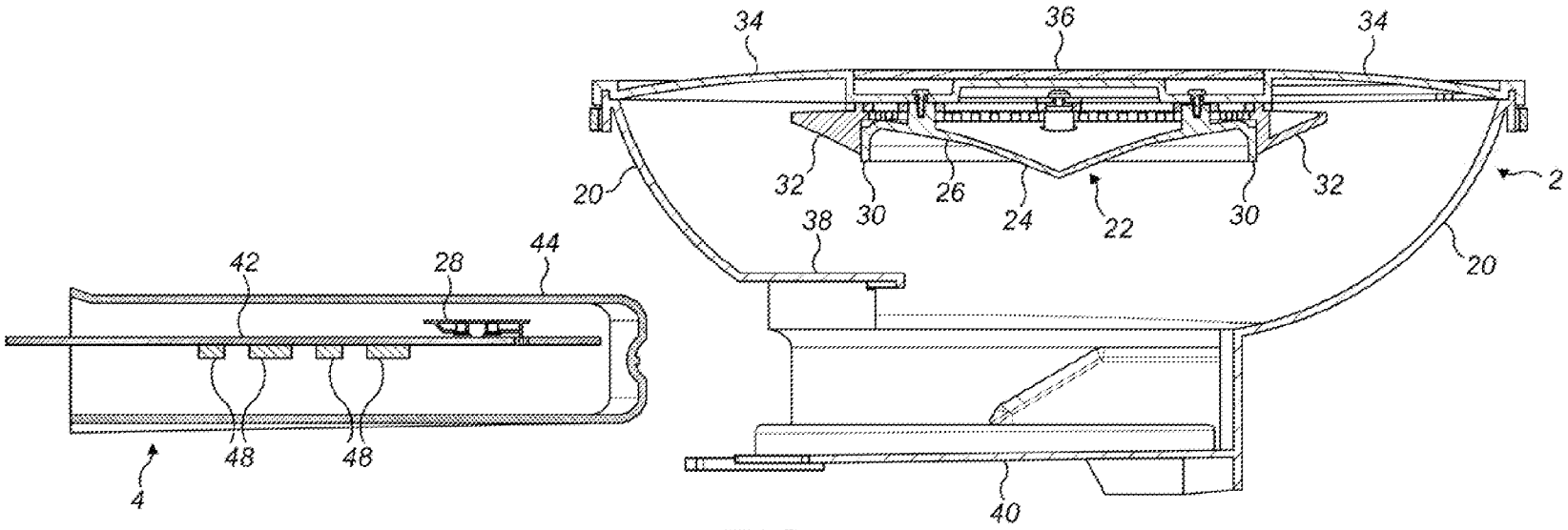
FIG. 7 is a view of a reflector arrangement according to an embodiment of the invention shown with a wireless communications terminal removed from the reflector arrangement.
Figure 8:
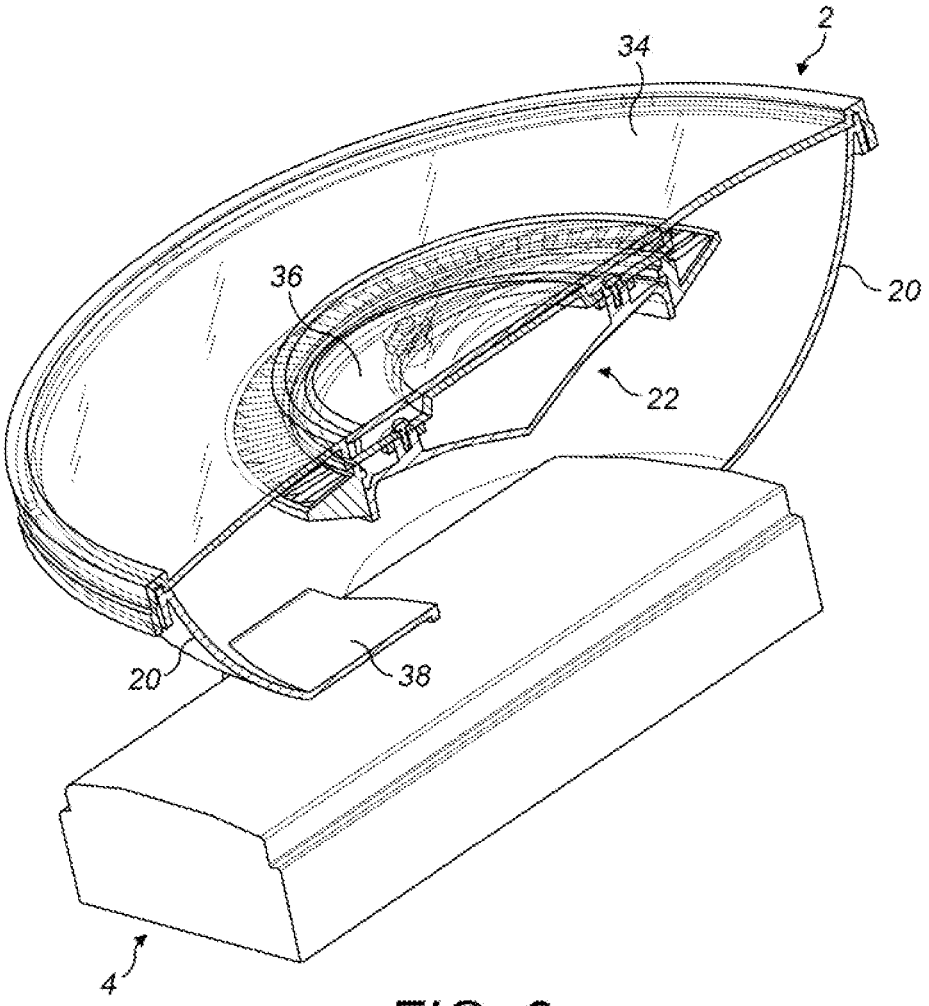
FIG. 8 is an oblique view of a reflector arrangement according to an embodiment of the invention sectioned to show the fitment of a wireless communications terminal.

The dielectric ring 32 may be seen in more detail, in an embodiment of the invention, by reference to FIGS. 6, 7 and 8. As can be seen in FIG. 8, at least some sectors of the dielectric ring have a greater thickness at the inner circumference of the dielectric ring than at the outer circumference of the dielectric ring, and preferably the dielectric ring is of substantially triangular cross-section for at least some sectors of the dielectric ring. It can be seen in FIG. 8 that the dielectric ring may have a structure of triangular vanes. It has been found that this structure is beneficial in the moulding process, and that the radio frequency performance is not adversely affected.

In an embodiment of the invention, in at least some sectors of the dielectric ring, for example in sectors corresponding top the vanes, the thickness of the dielectric ring at the inner circumference of the dielectric ring is between one quarter and three quarters of the distance by which the dielectric ring extends outwards from the perimeter of the sub-reflector.

In an embodiment of the invention the dielectric ring comprises alternate thick and thin sectors, for example radial vanes as shown in FIG. 8, arranged evenly around the circumference of the ring. The thick sectors of the dielectric ring may have a greater thickness, measured in a plane normal to an axis of rotational symmetry of the sub-reflector at at least one radial distance from the centre of the dielectric ring, than the thickness of the thin sectors at the same radial distance. In an embodiment of the invention, the thick sectors, that may be radial vanes, have a substantially triangular cross-section, spaced circumferentially by less than one eighth of a wavelength at an operating frequency of the antenna.

In an embodiment of the invention, the dielectric ring may be composed of a material having a relative permittivity in the range from 2 to 4, for example a polycarbonate material. Alternatively, the dielectric ring may be composed of a ceramic material, in which case the relative permittivity, also known as dielectric constant, may be greater than 4, typically in the range 9 to 11, but not limited to this.

FIG. 6 is a sectional view of a reflector arrangement 2 according to an embodiment of the invention when fitted to a wireless communications terminal 4, and FIG. 7 shows the reflector arrangement 2 with the wireless communications terminal 4 removed from the reflector arrangement.

It can be seen from FIGS. 6 and 7 that the wireless communications terminal 4 has a housing 44 including a section covering the patch antenna. In the embodiment of the invention shown, the patch antenna is formed of a patch radiator 28 which is parallel to a ground plane 42 that may be a layer of a printed circuit board. The ground plane plays a part in the operation of the patch antenna, but radiation is emitted and received primarily from the patch radiator 28. It can be seen that the reflector arrangement 2 is configured to fit over the housing 44 of the wireless communications terminal 4, so that the reflector arrangement 2 can be attached to the wireless communications terminal 4. Typically, the reflector arrangement 2, once attached, can be subsequently removed from the wireless communications terminal 4. It can be seen from FIGS. 6 and 7 that the reflector arrangement 2 may have a housing portion 40, attached to the main reflector 20, arranged to accommodate the terminal. The housing portion 40 may be moulded as one piece with the main reflector, and the housing portion and main reflector assembly may be arranged as a click fit over the terminal.

In an embodiment of the invention, the main reflector comprises a conductive layer, typically a metalisation, deposited on a moulded support substrate. As shown in FIG. 8, the main reflector 20 has a symmetric portion and an asymmetric portion, the symmetric portion being rotationally symmetric about an axis of the main reflector, and the asymmetric portion being shaped to accommodate the housing of the wireless communications terminal 4. As can be seen from FIG. 8, the main reflector may have a protruding section 38, typically substantially planar and arranged in a substantially parallel relationship with the housing 44 of the terminal 4, that protrudes into a volume that would be enclosed by the main reflector if it were entirely rotationally symmetrical. The protruding section 38 is typically metalised to shield the electronic components in the terminal from radiation and also to reflect radiation from the sub-reflector, as far as possible given the compromised shape, into the main beam from the main reflector. As shown in FIG. 8, the asymmetric portion of the main reflector comprises the protruding section 38 and also walls of the bowl of the main reflector 20 in the vicinity of the protruding section 38 that have a different curvature to the corresponding parts of the symmetric section of the main reflector, to compensate for reflections from the protruding section. Accommodating the housing of the terminal within a volume that would be enclosed by the main reflector if it were entirely rotationally symmetrical, that is to say within the bowl of the main reflector, has the benefit that combination of the reflector arrangement and the terminal may be shallower, in the direction of the main beam of the main reflector, than if the terminal were to be accommodate outside the bowl of the main reflector. Furthermore, arranging the combination to be shallower in this way also has the benefit that the diameter of the sub-reflector may be reduced, as it is brought closer to the internal antenna of the terminal, and consequently the diameter of the main reflector may be reduced. It is not obvious that the housing of the terminal may be accommodated within a volume that would be enclosed by the main reflector if it were entirely rotationally symmetrical, since this would be expected to impair the radiofrequency performance. It has been found that by careful design of the reflector shapes of the sub-reflector and main reflector, and the configuration of the reflector arrangement, that gain and sidelobe performance of the beam from the main reflector can be maintained within acceptable limits.

By reference to FIG. 6, it can be seen that, in an embodiment of the invention, the reflector arrangement 2 may comprise a substantially bowl shaped part, towards the centre of which is an aperture, into which the terminal 4 is arranged to protrude. In this way, the internal antenna in the terminal, comprising a patch radiator 28 operating in conjunction with a ground plane 42, may act as a feed antenna for the sub-reflector 22. The ground plane may be a layer of a printed circuit board, on which are placed components 48 of a radio transceiver, the components typically being placed on the opposite side of the ground plane 42 to the side on which the patch radiator 28 is placed.

As may be seen in FIG. 6, the subreflector may be moulded as one piece having a central substantially conical section 24, surrounded by an outer substantially truncated conical section 26, the truncated conical sections subtending a greater angle to a shared axis than the angle subtended to the shared axis by the central part. The central section and outer section may be joined by a smooth curve transitioning between the angles of the conical sections.

The dielectric ring 32, may be made, as shown, as a separate component from the sub-reflector, and may be made of a different material to that of the sub-reflector. This allows the use of a material that may have different dielectric properties to the material of which the sub-reflector is composed.

As shown in FIGS. 6, 7 and 8, the sub-reflector 22 may be supported by a radome 34, which is attached to the rim of the main reflector 20, and which provides environmental protection while being composed of a material, such as polycarbonate, through which radio frequency signals may propagate. The central part 36 of the radome, which is shielded from the main reflector by the metalised surface of the sub-reflector 22, is a cover for decorative purposes.

Figure 9:
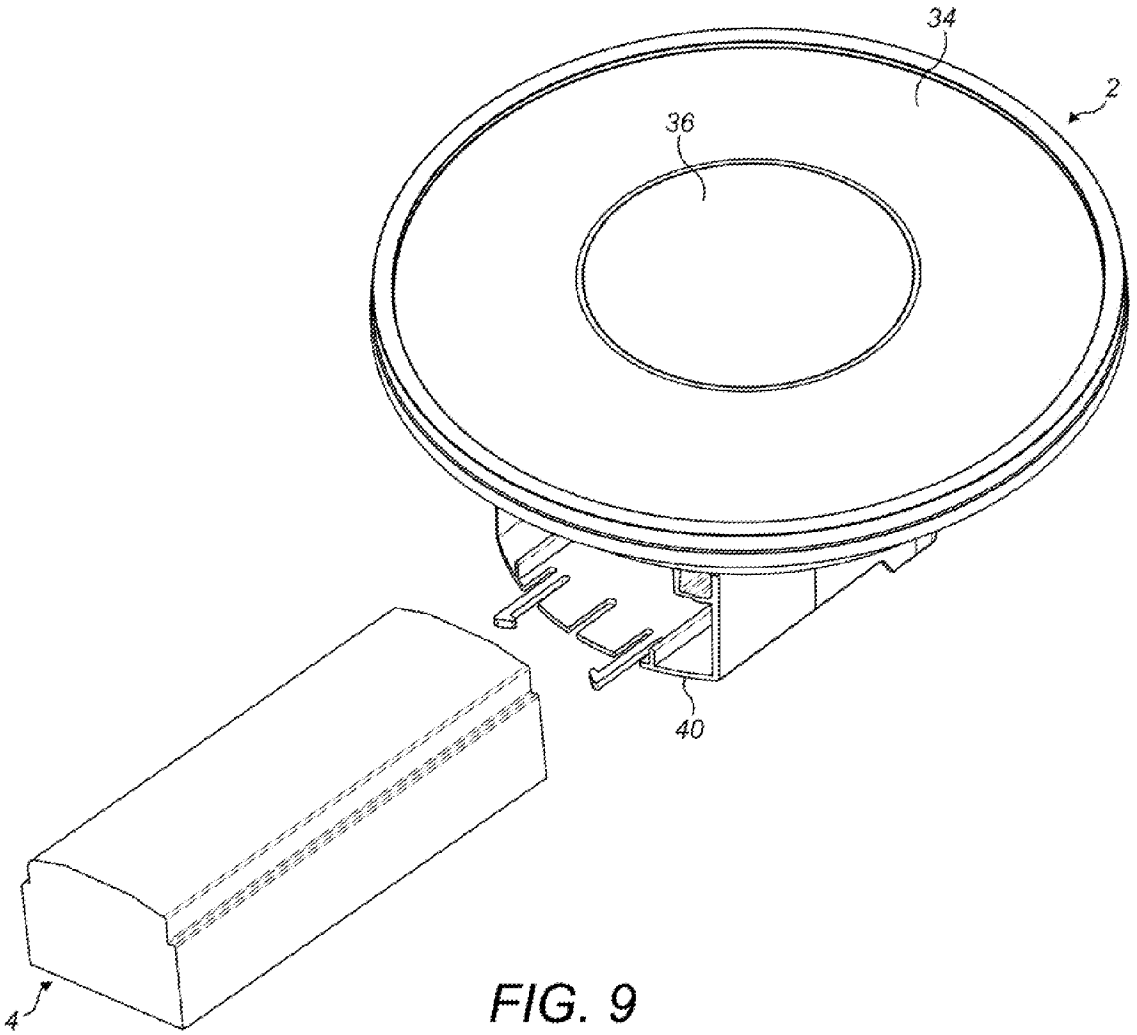
FIG. 9 is an oblique view of a reflector arrangement according to an embodiment of the invention shown with the wireless terminal removed.
Figure 10:
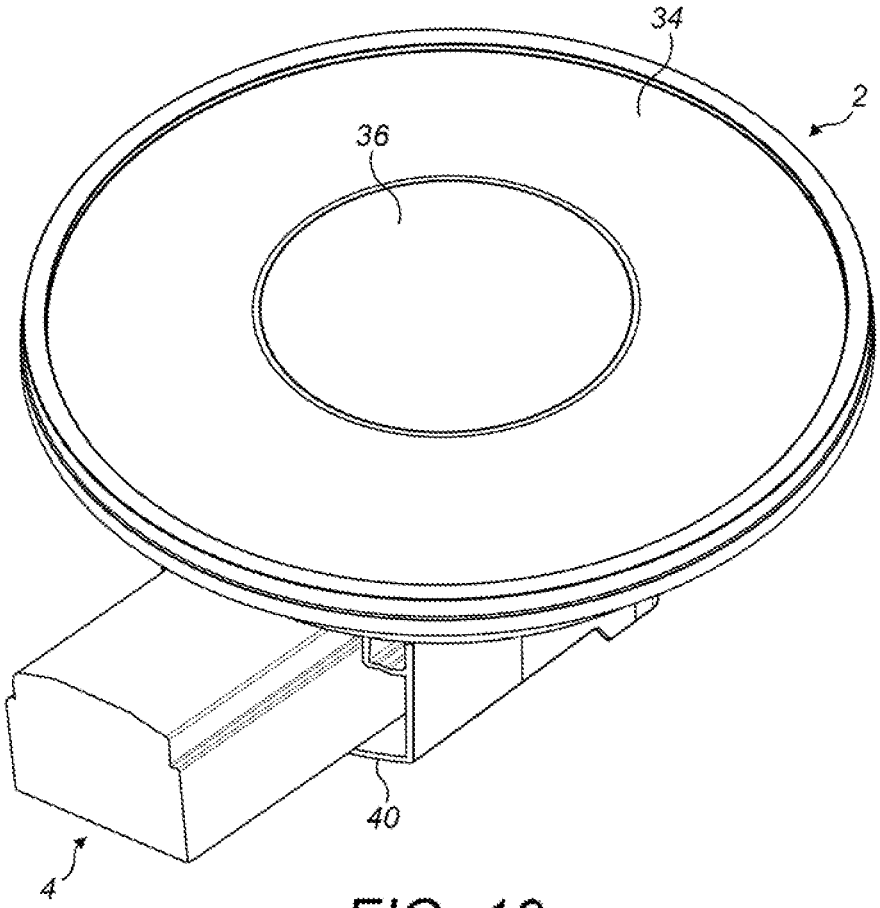
FIG. 10 is an oblique view of a reflector arrangement according to an embodiment of the invention shown with the wireless terminal fitted.

FIG. 9 is shows an oblique view of a reflector arrangement according to an embodiment of the invention shown with the wireless terminal removed and FIG. 10 shows an oblique view of a reflector arrangement according to an embodiment of the invention with the wireless terminal fitted. It may be seen that the wireless communications terminal 4 may be slid into a housing portion 40 of the reflector arrangement 2, which is arranged to accommodate the terminal with a clip-fit arrangement.

It will be understood that an antenna is reciprocal device, that may function as both a transmitter and a receiver. Where, for clarity, the foregoing description has used terminology relating to transmission of radio frequency signals, it should be understood that the reflector arrangement, and terminal, may be used for reception also. In particular, a patch radiator will be understood to act to receive radiation as well as transmit radiation. A transmission beam may also be used as reception beam, and a transmitter may be substituted by a receiver or a transceiver.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A communication arrangement comprising:

a wireless communications terminal, the wireless communications terminal comprising an internal patch antenna including a patch radiator disposed in a parallel relationship with a ground plane, the internal patch antenna being configured to produce a radiation beam of a predetermined beamwidth; and a reflector arrangement configured for attachment to the wireless communications terminal, the reflector arrangement being configured, when attached to the terminal, to produce a radiation beam of reduced beamwidth relative to said predetermined beamwidth, wherein the reflector arrangement comprises:

a main reflector having a symmetric portion and an asymmetric portion, the symmetric portion being generally bowl-shaped and rotationally symmetric about an axis of the main reflector, and the asymmetric portion being shaped to accommodate a housing of the wireless communications terminal; and a sub-reflector for reflecting radiation towards the main reflector, the sub-reflector comprising a reflective surface, at least a first section of the reflective surface being conical and having an apex, and the reflector arrangement being configured such that, when attached to the terminal, the apex extends towards the internal patch antenna, wherein the reflective surface of the sub-reflector comprises a further section surrounding said first section, the further section being shaped as a truncated cone having a substantially shared axis with said first section, the truncated cone subtending a greater angle to the shared axis than an angle subtended to the shared axis by said first section, and wherein the reflector arrangement is configured such that, when attached to the terminal, the internal patch antenna is positioned in an aperture of the main reflector to act as a feed antenna for the sub-reflector without the use of additional coupling antennas between the internal patch antenna and the sub-reflector, and wherein the sub-reflector is arranged to collect the radiation directly from the internal patch antenna and to reflect the beam towards the main reflector such that the main reflector produces the radiated beam of reduced beamwidth.

2. A communication arrangement according to claim 1, wherein a an area of a geometric projection of the reflective surface of the sub-reflector onto a plane normal to the direction of a radiation beam produced by the main reflector is greater than one eighth of an area of a geometric projection of the main reflector onto the plane normal to the direction of a radiation beam produced by the main reflector.

3. A communication arrangement according to claim 1, wherein the sub-reflector comprises a reflective barrier disposed around the perimeter of the sub-reflector, the reflective barrier extending from the perimeter of the sub-reflector towards the main reflector.

4. A communication arrangement according to claim 3, wherein the reflective barrier has a height measured in a direction towards the main reflector from the perimeter of said reflective surface of greater than one sixteenth of a wavelength and less than one quarter of a wavelength at an operating frequency of the antenna.

5. A communication arrangement according to claim 4, wherein the height of the reflective barrier is substantially one eighth of a wavelength at an operating frequency of the antenna.

6. A communication arrangement according to claim 3, wherein the reflective barrier is substantially perpendicular to a plane normal to the direction of a radiation beam produced by the feed antenna.

7. A communication arrangement according claim 1, further comprising a dielectric ring disposed around the perimeter of the sub-reflector, the dielectric ring extending radially outwards from the perimeter of the sub-reflector.

8. A communication arrangement according to claim 7, wherein the dielectric ring extends radially outwards from the perimeter of the sub-reflector by a distance of between one eighth and one half of a wavelength at an operating frequency of the antenna.

9. A communication arrangement according to claim 7, wherein at least some sectors of the dielectric ring have a greater thickness adjacent to the inner circumference of the dielectric ring than adjacent to the outer circumference of the dielectric ring.

10. A communication arrangement according to claim 9, wherein the dielectric ring is of substantially triangular cross-section for at least some sectors of the dielectric ring.

11. A communication arrangement according to claim 9, wherein, in at least some sectors of the dielectric ring, the thickness of the dielectric ring adjacent to the inner circumference of the dielectric ring is between one quarter and three quarters of the distance by which the dielectric ring extends outwards from the perimeter of the sub-reflector.

12. A communication arrangement according to claim 7, wherein the dielectric ring comprises alternate thick and thin sectors, arranged evenly around the circumference of the dielectric ring, in which the thick sectors of the dielectric ring have a greater thickness, measured in a plane normal to an axis of rotational symmetry of the sub-reflector at at least one radial distance from the centre of the dielectric ring, than the thickness of the thin sections at said radial distance.

13. A communication arrangement according to claim 12, wherein said thick sectors are arranged as radial vanes having a substantially triangular cross-section, spaced circumferentially by less than one eighth of a wavelength at an operating frequency of the antenna.

14. A communication arrangement according to claim 7, wherein the dielectric ring is composed of a material having a relative permittivity in the range from 2 to 4.

15. A communication arrangement according to claim 7, wherein the dielectric ring is composed of a polycarbonate material.

16. A communication arrangement according to claim 1, the wireless communications terminal having a housing including a section covering the patch antenna, wherein the reflector arrangement is configured to fit over the housing of the wireless communications terminal, whereby to attach the reflector arrangement to the wireless communications terminal.

17. A reflector arrangement configured for attachment to a wireless communications terminal, the wireless communications terminal comprising an internal patch antenna configured to produce a radiation beam of a predetermined beamwidth, the reflector arrangement comprising:

a main reflector having a symmetric portion and an asymmetric portion, the symmetric portion being generally bowl-shaped and rotationally symmetric about an axis of the main reflector, and the asymmetric portion being shaped to accommodate a housing of the wireless communications terminal; and a sub-reflector for reflecting radiation towards the main reflector, the sub-reflector comprising a reflective surface, at least a first section of the reflective surface being substantially conical and having an apex, and the reflector arrangement being configured such that, when attached to the terminal, the apex extends towards the internal patch antenna, wherein the reflective surface of the sub-reflector comprises a further section surrounding said first section, the further section being shaped as a truncated cone having a substantially shared axis with said first section, the truncated cone subtending a greater angle to the shared axis than an angle subtended to the shared axis by said first section, and the reflector arrangement being configured for attaching the communications terminal to the reflector arrangement which positions the internal patch antenna of the communications terminal in an aperture of the main reflector, and the reflector arrangement being configured for attaching the sub-reflector to the main reflector which positions the sub-reflector to receive radiation directly from the internal patch antenna without the use of additional coupling antennas between the internal patch antenna and the sub-reflector, wherein the reflector arrangement is configured such that, when attached to the terminal, the sub-reflector is arranged to reflect radiation from the internal patch antenna towards the main reflector such that the main reflector produces a radiated beam of reduced beamwidth relative to the predetermined beamwidth of the internal patch antenna.

* * * * *